US008302985B2

(12) United States Patent
Ruby

(10) Patent No.: US 8,302,985 B2
(45) Date of Patent: Nov. 6, 2012

(54) WHEELCHAIR FOOTPAD DEVICE

(76) Inventor: Ethan Evan Ruby, Cold Spring, NY (US)

( * ) Notice: Subject to any disclaimer, the term of this patent is extended or adjusted under 35 U.S.C. 154(b) by 322 days.

(21) Appl. No.: 12/833,685

(22) Filed: Jul. 9, 2010

(65) Prior Publication Data

US 2012/0007333 A1 Jan. 12, 2012

(51) Int. Cl.
*A47C 7/50* (2006.01)

(52) U.S. Cl. ..... 280/304.1; 297/423.18

(58) Field of Classification Search ..... 280/250.1, 280/304.1; 297/423.18
See application file for complete search history.

(56) References Cited

U.S. PATENT DOCUMENTS 3,848,922 A * 11/1974 Blanford ..... 297/219.1
4,243,265 A * 1/1981 Hanik ..... 297/423.1
4,463,985 A 8/1984 Kynast
4,753,480 A * 6/1988 Morell ..... 297/452.27
5,002,047 A * 3/1991 Sandvig et al. ..... 602/8
5,052,128 A 10/1991 Lonardo
5,088,747 A * 2/1992 Morrison et al. ..... 297/219.1
5,093,944 A 3/1992 Winston, Sr.
5,163,737 A * 11/1992 Navach et al. ..... 297/452.25
5,189,747 A * 3/1993 Mundy et al. ..... 5/654
5,306,074 A * 4/1994 Mocur ..... 297/423.31
5,603,336 A * 2/1997 Shepich ..... 128/882
5,679,039 A * 10/1997 Robles ..... 441/70
6,209,159 B1 * 4/2001 Murphy ..... 5/654
6,840,577 B2 * 1/2005 Watkins ..... 297/284.9
6,929,275 B1 * 8/2005 Schlangen ..... 280/250.1
7,121,572 B1 * 10/2006 Jaffe et al. ..... 280/304.1
7,347,498 B2 * 3/2008 Clifford ..... 297/452.21
7,367,578 B2 * 5/2008 Jansen ..... 280/304.1
7,455,651 B2 11/2008 Mollica
2005/0121964 A1 * 6/2005 Holcomb et al. ..... 297/452.29
2007/0216122 A1 * 9/2007 Cornelius et al. ..... 280/87.05
2009/0189432 A1 7/2009 Anikin
2010/0102534 A1 * 4/2010 Hunnicutt, Jr. ..... 280/643
2012/0084925 A1 * 4/2012 Frazier ..... 5/657

* cited by examiner

*Primary Examiner* — Kevin Hurley
(74) *Attorney, Agent, or Firm* — Cowan, Liebowitz & Latman, P.C.; Mark Montague, Esq.

(57) ABSTRACT

This invention relates to a footpad device that is removably attached to a wheelchair's footplate and more particularly to a footpad device specifically dimensioned to correct the posture of a person with bare feet sitting in the wheelchair fitted to that person while wearing shoes. The footpad device is made of a flexible water resistant material to help support bare feet when they are wet and is shaped to help prevent bare feet from slipping off the side of the footplate.

19 Claims, 6 Drawing Sheets

WHEELCHAIR FOOTPAD DEVICE

BACKGROUND OF THE INVENTION

This invention relates to a footpad device that is removably attached to a wheelchair's footplate and more particularly to a footpad device specifically dimensioned to correct the posture of a person with bare feet sitting in the wheelchair fitted to that person while wearing shoes. Also, the footpad device is made of a flexible water resistant material to help support bare feet when they are wet and is shaped to help prevent bare feet from slipping off the side of the footplate.

A wheelchair is normally fitted to the specific person who will be using that wheelchair for an extended period of time. A properly fitted wheelchair is necessary to ensure proper body alignment and to preserve skin integrity. Typically, a licensed physical or occupational therapist will measure the full length of a person's body in order to identify those seating dimensions which will effectively fit the wheelchair to that person.

The seating dimensions of a wheelchair influence multiple physical characteristics of the person using that wheelchair. These physical characteristics include the angle at which a foot is supported when placed on a footplate. This angle has a direct affect on a person's knee to foot extension and the position of that person's thighs within the wheelchair. These characteristics, in turn, directly affect a person's hip and back alignment within the wheelchair. Proper alignment of all these physical characteristics is necessary to achieve a proper balance within the wheelchair and to help prevent unnecessary skin pressure over an extended period of time which often results in skin breakdown.

The alignment of a wheelchair starts with the placement of the footplate at a position which keeps each foot flexed at a 90 degree angle relative to the lower leg. As discussed above, the footplate's placement directly affects the alignment of a person's hips and knees while seated in the wheelchair. A one degree offset in a foot's angle is enough to compromise that person's balance within the wheelchair and will result in harm to that person's joints and skin over an extended period of time. A person is normally measured for a wheelchair while wearing shoes since it is assumed that the majority of time spent in the wheelchair will be while dressed. As such, the normal placement of the footplate does not provide for those times when a person is barefoot within the wheelchair. As a result, a person's bare feet will need to drop below the 90 degree angle to reach the fitted footplate. Consequently, their knee and hip angles will both be offset from their properly balanced positions.

A change in the hip angle will effectively offset the gluteus muscles which support the majority of the person's body weight against the wheelchair's seat. Moreover, an increase in the hip angle will cause the person to move forward in the wheelchair's seat. As a result, the knee angle is reduced, causing the posterior knee to come into contact with the wheelchair's seat and placing increased pressure on the skin. Also, the lower extremities rotate putting the lateral aspect of both knees in contact with the metal uprights of the footplate, which also puts increased pressure on the boney aspects of skin in that area of the lower leg. Lastly, both hips experience a shortening of the external rotator muscles making it more difficult to properly balance oneself in the wheelchair and properly align the lower back.

A bare foot that bends past the 90 degree angle to reach the footplate will hang off the front of the footplate and will press against the front edge of that footplate. A bare foot that hangs over the front of the footplate is likely to come into contact with obstacles while the wheelchair is in motion and at a greater risk of suffering cuts, scrapes and a broken toe. Moreover, since the footplate is normally made of metal or a hard plastic, a bare foot pressing against the footplate for an extended period of time will also suffer skin damage.

Accordingly, one purpose of this invention is to provide a footpad device that properly supports a person's bare feet while seated in a wheelchair fitted to that person while wearing shoes.

It is a further purpose of this invention to provide a footpad device that is water resistant and that is designed to help prevent bare feet from slipping off of the wheelchair's footplate.

It is a further purpose of this invention to provide a footpad device which is easily attached to and easily removed from a footplate thereby allowing a wheelchair to remain properly fitted to a person both when wearing shoes and when barefoot.

It is a further purpose of this invention to provide for a footpad device which supports bare feet at a height which may be incrementally adjusted using a system of stacked footpads of varying heights.

BRIEF DESCRIPTION OF THE INVENTION

A wheelchair footpad device comprising a rigid support element, a flexible foam element, a lower surface of the foam element resting against and supported by an upper surface of the support element, the foam element having a height that is substantially equal to the height of a sole of a sneaker or shoe and a coupling element that removably attaches the lower surface of the support element to the upper surface of a wheelchair's footplate, the wheelchair having been fitted to a person wearing shoes, the footpad device attached to the footplate supporting the person's feet while not wearing shoes at substantially the same height and angle as the footplate alone would support the person's feet while wearing shoes.

A wheelchair footpad device attached to a footplate of a wheelchair that is fitted for a person wearing shoes, the footpad device comprising a rigid support element, a flexible foam element, a lower surface of the foam element resting against and supported by an upper surface of the support element, the foam element having a height that is substantially equal to the average height of a sole of a sneaker or shoe and a coupling element that removably attaches the lower surface of the support element to the upper surface of a wheelchair's footplate, the footpad device attached to the footplate supporting person's feet while not wearing shoes at substantially the same height and angle as the footplate alone would support the person's feet while wearing shoes.

DETAILED DESCRIPTION OF THE INVENTION

Figure 1:
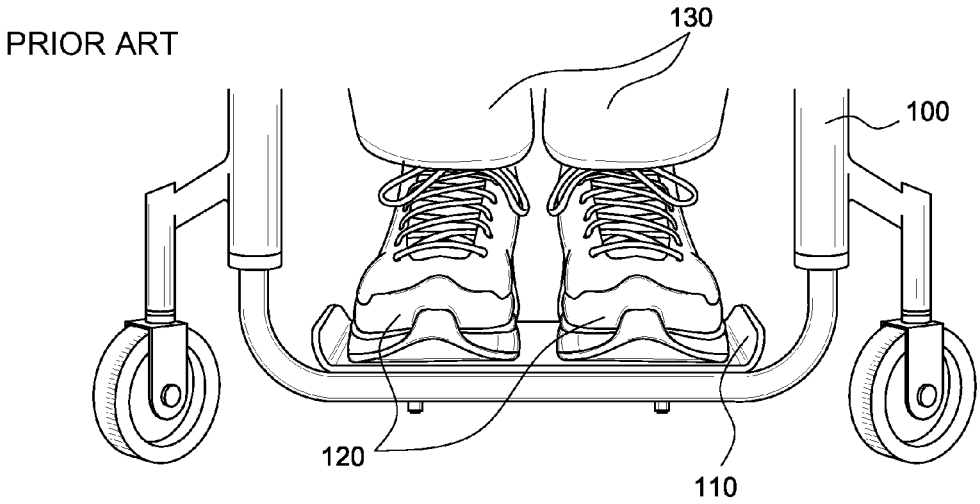
FIG. 1 shows feet with shoes positioned on the footplate of a wheelchair fitted for a person wearing shoes.

FIG. 1 shows a person with shoes 120 seated in a wheelchair 100 that has been fitted for a person wearing shoes. The wheelchair's footplate 110 is positioned to maintain the person's feet at a 90 degree angle relative to each leg 130. Maintaining a person's feet at that 90 degree angle is crucial to properly balance a person while seated in a wheelchair.

Figure 2:
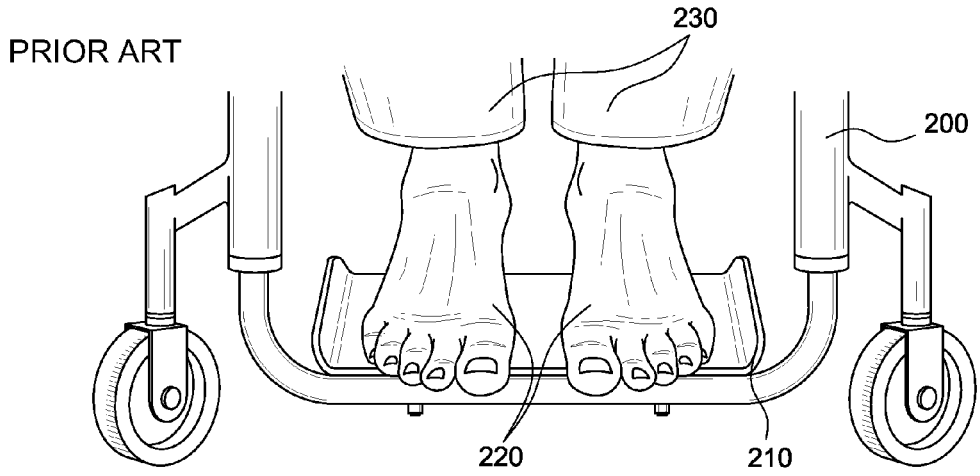
FIG. 2 shows feet without shoes positioned on the footplate of a wheelchair fitted for a person wearing shoes.

FIG. 2 shows a person without shoes seated in a wheelchair 200 that has been fitted for a person wearing shoes. As shown, that person's feet 220 are no longer supported by the footplate 210 at a 90 degree angle relative to each leg 230. Rather, each foot 220 either hangs off the front of the footplate 210 or presses directly against the front edge of the footplate 210. As a result, a person with bare feet 220 is not able to properly balance himself within the wheelchair 200 and his bare feet 220 are more susceptible to injury while the wheelchair 200 is in motion.

Figure 3:
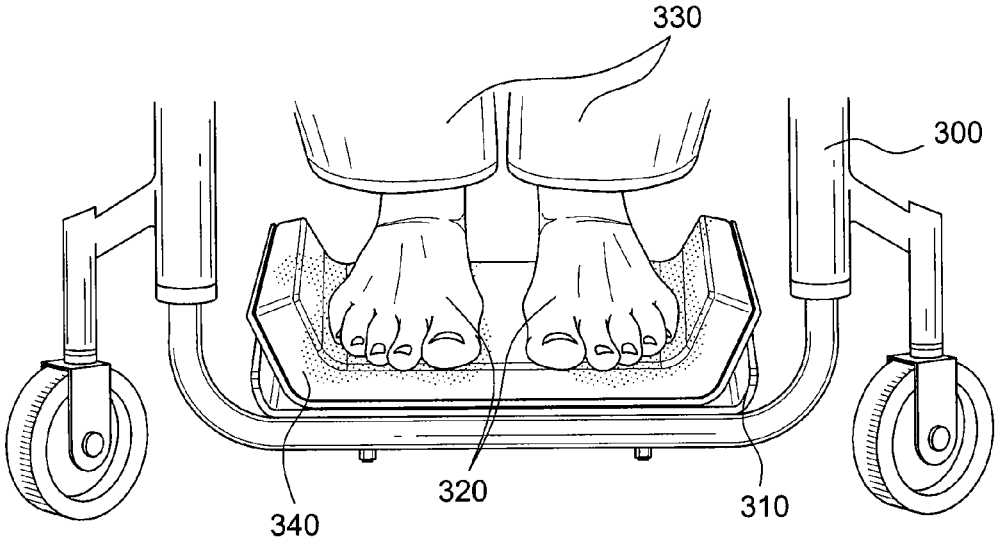
FIG. 3 shows feet without shoes positioned on a footpad device attached to the footplate of a wheelchair fitted for a person wearing shoes.

FIG. 3 shows a person without shoes seated in a wheelchair 300 that has been fitted for that person wearing shoes and using a footpad device 340 of the present invention. As shown, the footpad device 340 is attached directly to the upper surface of the footplate 310. The added height provided by the footpad device 340 now enables that same footplate 310 to support bare feet at the desired 90 degree angle relative to each leg 330. As a result, a person with bare feet 320 is now properly balanced within a wheelchair 300 that is fitted for that person while wearing shoes. Moreover, the bare feet 320 are protected from injury while the wheelchair 300 is in motion.

Figure 4:
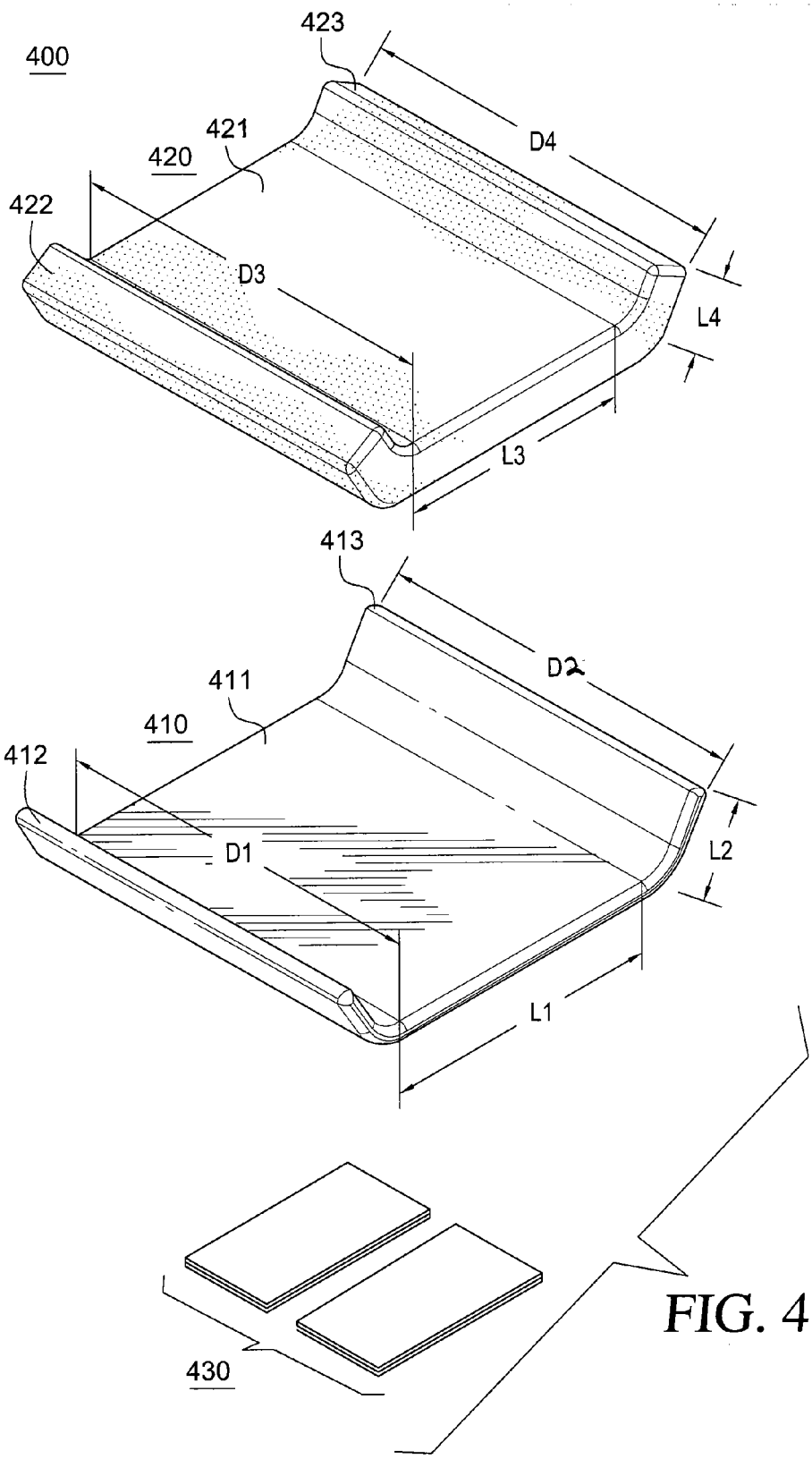
FIG. 4 shows an exploded view of the footpad device.

FIG. 4 shows an exploded view of the footpad device 400 of the present invention. As shown, the footpad device is comprised of a support element 410, a foam element 420 and one or more coupling elements 430. In some embodiments, an adhesive layer may be applied to a bottom surface of the support element 410 instead of or in addition to the coupling element.

The support element 410 includes a base 411 and a pair of upward rising wings 412, 413 positioned on opposing edges on the base 411, each wing running the full length of the corresponding opposing edge. As shown, in this embodiment the wings 312 an 413 are integrally formed with base 411. The support element's base 411 and wings 412, 413 are made of material having sufficient rigidity to support the foam element 420, such materials including metal and hard plastic or rubber.

In this embodiment, the support element's base 411 is rectangular with a length L1 and a depth D1 substantially equal to that of the standard footplate to which the footpad device will be attached. The wings 412 and 413 have a depth D2 substantially equal to the base's depth D1 and a length L2 substantially smaller than the base's length L1.

The foam element 420 also includes a base 421 and a pair of upward rising wings 422 and 423 positioned on opposing edges of the base 421, each wing running the full length of the corresponding opposing edge. The foam element's base 421 and wings 422, 423 are made of dense closed cell foam that is impervious to moisture and whose surface provides traction to bare feet when wet.

In this embodiment, the foam element's base 421 and wings 422, 423 are each shaped and dimensioned to fit within the upper surface boundaries of the support unit 410. Specifically, the foam element's base 421 is rectangular with a length L3 and a depth D3 substantially equal to the length L1 and depth W1 of the support unit's base 411. Similarly, the foam element's wings 422, 423 have a length L4 and depth D4 substantially equal to the length L2 and depth D2 of the support element's wings 412, 413.

The lower surface of the foam element 420 is securely attached to the upper surface of the support unit 410 using any known method or substance. For example, an adhesive layer or an adhesive member may be used for attaching the foam element to the support unit.

Figure 5:
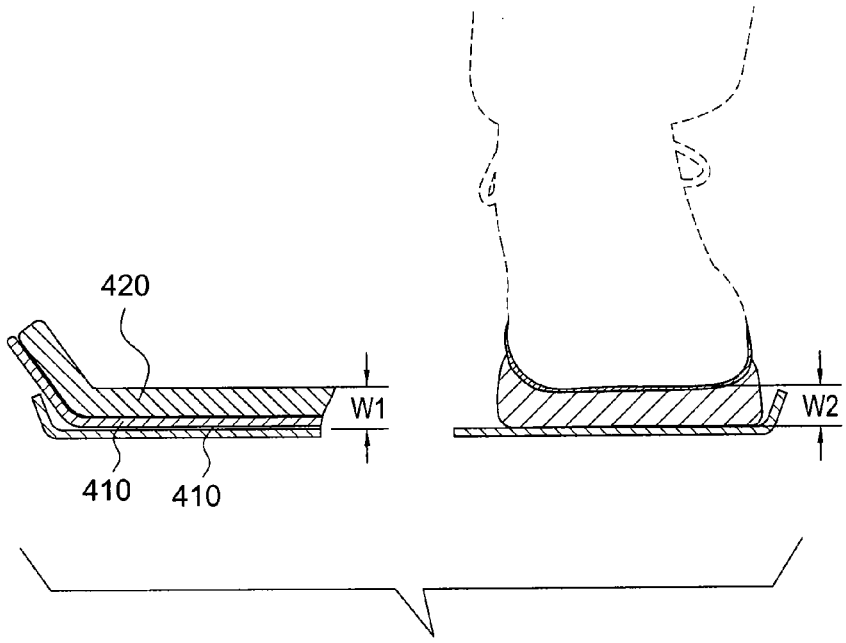
FIG. 5 shows the foam element of the footpad device and the sole of a common sneaker or shoe.

As shown in FIG. 5, the height W1 of the foam element 420 is substantially equal to the height W2 of the bottom sole on an average sneaker or shoe. As a result, a footpad device resting on the upper surface of a footplate fitted to a person wearing shoes will maintain bare feet at a height substantially equal to the height of feet wearing shoes supported by the footplate alone.

Moreover, the footpad device maintains bare feet at the same 90 degree angle used to define the proper position of the footplate when the wheelchair was fitted to a person wearing shoes.

Therefore, the defined height of the foam element 420 compensates for the missing height provided by the sole of a common sneaker or shoe. As such, the footpad device maintains bare feet at the height and angle necessary to achieve proper balance within a wheelchair that is fitted for a person wearing shoes.

The coupling element 430 may be any means of temporarily attaching the base unit 410 the footplate of a wheelchair. In this embodiment, the coupling element 430 is VELCRO® hook and loop fastener tape attached to the lower surface of the base unit 410 and the upper surface of the footplate. The coupling element 430 allows for easily attaching the footpad device 400 to a wheelchair's footplate when the person in the wheelchair is barefoot. Similarly, the coupling element 430 allows for easily removing the footpad 400 from the footplate when that person transitions to wearing shoes.

Although the footpad device of the present invention and its component elements have been described as having a rectangular shape and having dimensions substantially equal to that of a wheelchair's footplate, this description is for exemplary purposes only and is not meant to limit the invention to any single shape or size. It is foreseen that the footpad device of the present invention could be any other shape and size which effectively supports a person's feet and which securely fits on the upper surface of the wheelchair's footplate.

In another embodiment of the present invention, the footpad device provides for incrementally adjusting the height at which a bare that are supported by the footpad device above a wheelchair's footplate.

Figure 6:
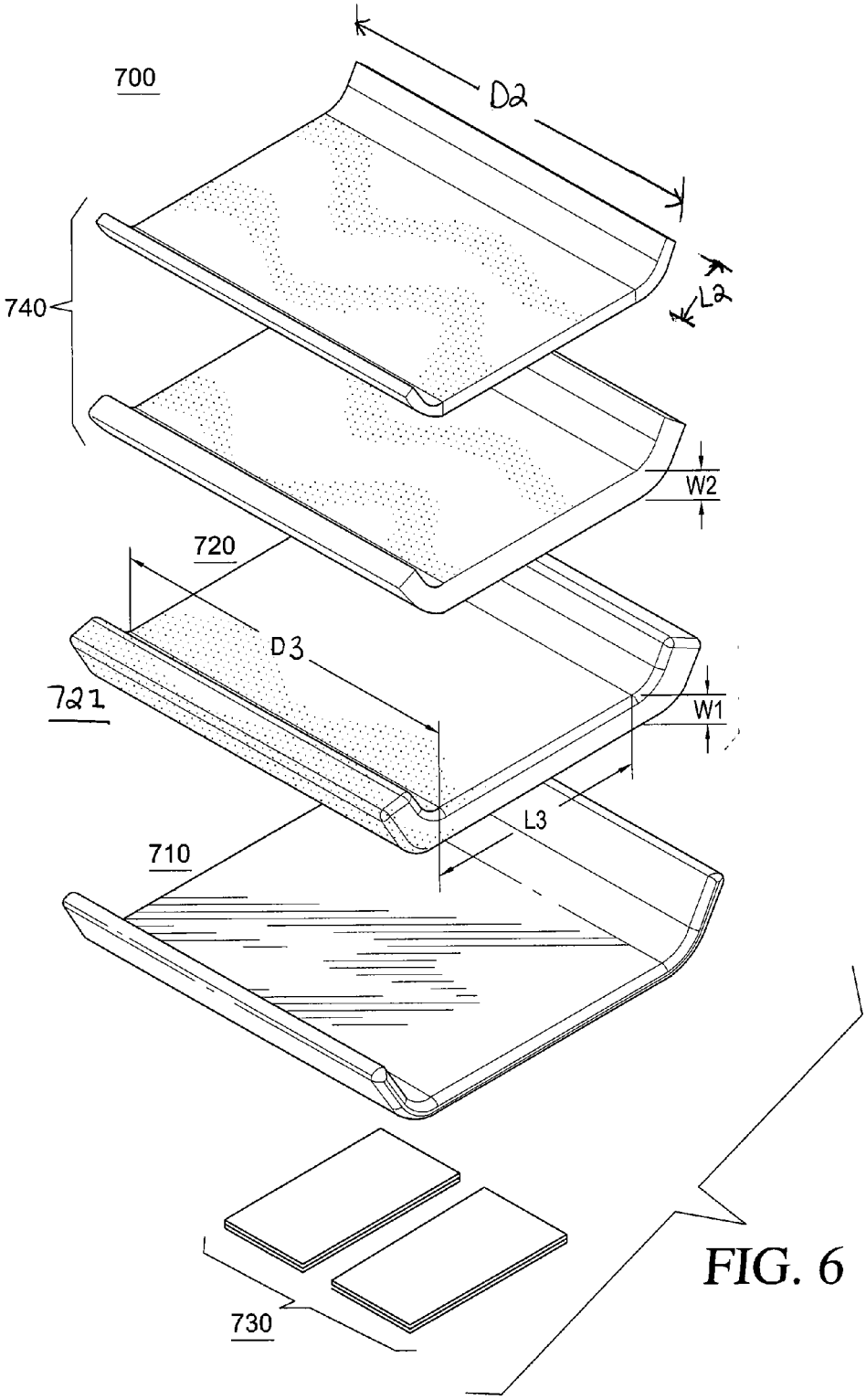
FIG. 6 shows an exploded view of another embodiment of the footpad device that includes multiple stacked foam elements of varying heights.

FIG. 6 shows an exploded view of the footpad device of the present embodiment. As shown the footpad device 700 includes a support element 710, a foam element 720, a coupling element 730 and one or more incremental foam elements 740.

The support element 710, the foam element 720 and the coupling element 730 are all similar to those described in the previous embodiment. However, in this embodiment, the foam element 720 has a height W that is substantially equal to or less than the bottom sole of an average sneaker or shoe. The addition of one or more incremental foam elements 740 on top of the foam element 720 allows for flexibility in defining the final height at which bare feet are supported above the footplate. In this way, a person can easily customize the height of the footpad device based on the person's specific needs.

The incremental foam elements 740 are made of the same closed cell foam as the foam element 720 and have the same shape as the foam element's base 721. Similarly, the length L2 and depth D2 of the incremental foam elements are dimensioned to fit on to equal to the foam element's base 721. However, the incremental foam elements 740 have a variety of heights, all of which are substantially smaller than the height W1 of the foam element.

When assembling the footpad device, one or more incremental foam elements 740 are positioned on top of the foam element 720 to achieve a desired cumulative height W2. In this manner, the cumulative height may be incrementally adjusted to achieve the desired height at which a person's bare feet are supported above the footplate.

A coupling element is applied to the bottom surface of each incremental foam element 740 to securely attach that incremental foam element to the upper surface of the underlying element on which it rests. The coupling element may be VELCRO® hook and loop fasteners or an adhesive layer or any other suitable coupling means.

In yet another embodiment of the present invention, the footpad device is implemented on a wheelchair having a multiple footplates.

Figure 7:
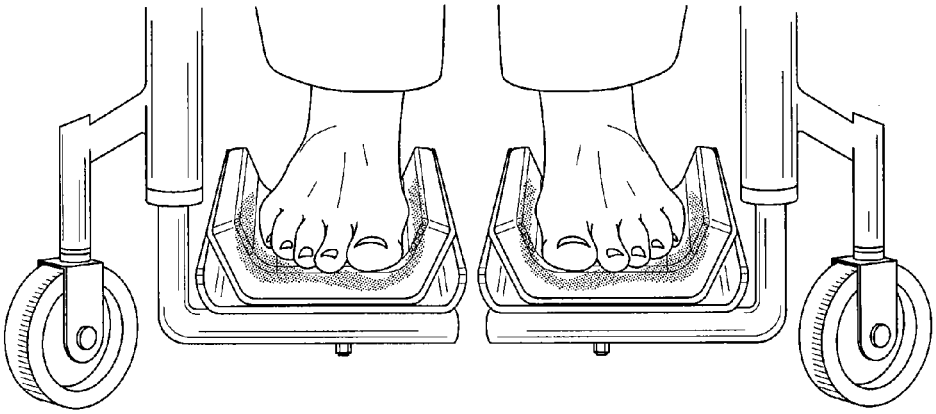
FIG. 7 shows the footpad device implemented on a wheelchair having multiple footplates.

FIG. 7 shows a footpad device implemented on a wheelchair having two footplates, each footplate fitted to one foot wearing a shoe. As shown, a footpad device is attached to each footplate. All previously described elements and characteristics of the footpad device used on a wheelchair having a single footplate are applicable to each footpad device used on a wheelchair having multiple footplates.

In all cases, it is understood that the above-described arrangements are merely illustrative of the many possible specific embodiments which represent applications of the present invention. Numerous and varied other arrangements can be readily devised in accordance with the principles of the present invention without departing from the spirit and scope of the invention.

The invention claimed is:

1. A wheelchair footpad device comprising:

a rigid support element;

a flexible foam element, a lower surface of the foam element resting against and supported by an upper surface of the support element, the foam element having a height that is substantially equal to a predetermined height of a sole of a sneaker or shoe; and a coupling element that removably attaches a lower surface of the support element to an upper surface of a wheelchair's footplate, the wheelchair having been fitted to a person wearing shoes;

wherein the footpad device is attached to the footplate.

2. The wheelchair footpad device of claim 1 wherein the foam element is made of dense closed cell foam that resists damage from moisture and having a surface that provides traction when wet.

3. The wheelchair footpad device of claim 1 wherein the coupling element is hook and loop fastener tape attached to the lower surface of the support element and the upper surface of the wheelchair's footplate.

4. The wheelchair footpad device of claim 1 wherein the support element includes a pair of rigid upward rising wings each extending from an opposing edge of the support element; and wherein the foam element includes a pair of flexible upward rising wings each extending from an opposing edge of the foam element, a lower surface of the wings of the foam element resting against and supported by an upper surface of the support element wings.

5. The wheelchair footpad device of claim 4 wherein the foam element wings run the full longitudinal length of the opposing edges of the foam element from which they extend.

6. The wheelchair footpad device of claim 4 wherein the foam element wings are made of the same dense closed cell foam as the foam element.

7. The wheelchair footpad device of claim 1 wherein the foam element includes a plurality of foam strips stacked on one another and removably secured to each other, the foam strips having respectively different heights and providing for incremental adjustment of the height of the foam element.

8. The wheelchair footpad device of claim 1 for use with a wheelchair that includes multiple footplates, wherein the footpad device includes a separate footpad device attached to each of the footplates.

9. A wheelchair footpad device attached to a footplate of a wheelchair that is fitted for a person wearing shoes, the footpad device comprising:

a rigid support element;

a flexible foam element, a lower surface of the foam element resting against and supported by an upper surface of the support element, the foam element having a height that is substantially equal to a predetermined height of a sole of a sneaker or shoe; and a coupling element that removably attaches a lower surface of the support element to an upper surface of a wheelchair's footplate;

wherein the footpad device is attached to the footplate.

10. The wheelchair footpad device of claim 9 wherein the foam element is comprised of a dense closed cell foam that resists damage from moisture and having a surface that provides traction when wet.

11. The wheelchair footpad device of claim 9 wherein the coupling element is hook and loop fastener tape attached to the lower surface of the support element and the upper surface of the wheelchair's footplate.

12. The wheelchair footpad device of claim 9 wherein the support element includes a pair of rigid upward rising wings each extending from an opposing edge of the support element; and wherein the foam element includes a pair of flexible upward rising wings each extending form an opposing edge of the foam element, a lower surface of the wings of the foam element resting against and supported by an upper surface of the support element wings.

13. The wheelchair footpad device of claim 12 wherein the foam element wings run the full longitudinal length of the opposing edges of the foam element from which they extend.

14. The wheelchair footpad device of claim 12 wherein the foam element wings are made of the same dense closed cell foam as the foam element.

15. The wheelchair footpad device of claim 9 wherein the foam element includes a plurality of foam strips stacked and removably secured to each other, the foam strips having respectively different heights and providing for incremental adjustment of the height of the foam element.

16. The wheelchair footpad device of claim 9 wherein the wheelchair includes multiple footplates, and wherein the footpad device includes a separate footpad device attached to each of the footplates.

17. A system, comprising:

a wheelchair having a footplate for supporting a person's feet; and a wheelchair footpad device coupled to the footplate of the wheelchair, the wheelchair footpad device having:

a rigid support element, a flexible foam element, a lower surface of the foam element resting against and supported by an upper surface of the support element, the foam element having a predetermined height; and a coupling element coupling a lower surface of the support element to an, upper surface of the footplate of the wheelchair.

18. The system of claim 17 wherein the coupling element is hook and loop fastener tape attached to the lower surface of the support element and the upper surface of the footplate of the wheelchair.

19. The system of claim 17 wherein the wheelchair has two footplates and the wheelchair footpad device is coupled to a first of the two footplates, and the system comprises a second wheelchair footpad device coupled to an upper surface of a second of the two footplates of the wheelchair, the second wheelchair footpad device having a rigid support element and a flexible foam element coupled to an upper surface of the support element of the second wheelchair footpad device.

* * * * *